US009063498B2

(12) United States Patent
Yahagi

(10) Patent No.: US 9,063,498 B2
(45) Date of Patent: Jun. 23, 2015

(54) IMAGE FORMING APPARATUS

(71) Applicant: CANON KABUSHIKI KAISHA, Tokyo (JP)

(72) Inventor: Takashi Yahagi, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/219,841

(22) Filed: Mar. 19, 2014

(65) Prior Publication Data

US 2014/0286659 A1 Sep. 25, 2014

(30) Foreign Application Priority Data

Mar. 25, 2013 (JP) ..... 2013-061606

(51) Int. Cl.
*G03G 15/00* (2006.01)

(52) U.S. Cl.
CPC ..... *G03G 15/5058* (2013.01)

(58) Field of Classification Search
CPC ..... G03G 15/5058; G03G 2215/00042; G03G 2215/00037; G03G 2215/00059
USPC ..... 399/49, 409
See application file for complete search history.

(56) References Cited

FOREIGN PATENT DOCUMENTS

| | | | |
|---|---|---|---|
| JP | 60-120369 | A | 6/1985 |
| JP | 3-36559 | A | 2/1991 |
| JP | 2003-248410 | A | 9/2003 |

*Primary Examiner* — David Bolduc
*Assistant Examiner* — Barnabas Fekete
(74) *Attorney, Agent, or Firm* — Canon USA, Inc. IP Division

(57) ABSTRACT

An image forming apparatus includes an image bearing member, an image forming unit configured to form a toner image on the image bearing member, a conveyance member configured to transfer the toner image formed on the image bearing member onto a recording material and to convey the recording material, a detection member configured to detect the toner image on the conveyance member, and a control portion configured to set a position of a toner image, to be formed by the image forming unit, relative to the recording material based on a result obtained by forming a test toner image so as to extend over the conveyance member and an end portion of the recording material, transferring the formed test toner image onto the conveyance member and the recording material, and causing the detection member to detect the test toner image transferred onto the conveyance member.

10 Claims, 9 Drawing Sheets

IMAGE FORMING APPARATUS

BACKGROUND OF THE INVENTION

1. Field of the Invention

The present invention relates to an image forming apparatus, such as a copying machine and a laser beam printer, that has the function to transfer a toner image onto a sheet (a recording material).

2. Description of the Related Art

In conventional image forming apparatuses, such as copying machines and laser beam printers, using electrophotographic techniques, a print (printing) position relative to a recording material may deviate due to the accuracy of conveyance of the recording material, the variance of the conveyance accuracy, or the accuracy of position of a toner image to be printed. Therefore, there have been proposed various techniques regarding the alignment (registration) of a toner image relative to a recording material.

For example, Japanese Patent Application Laid-Open No. 60-120369 discusses the technique to temporarily stop a registration roller pair at a point of time when the recording material reaches a detection sensor and then re-start driving the registration roller pair with precise timing to perform registration.

Also, Japanese Patent Application Laid-Open No. 3-36559 discusses the technique to arrange a recording-material detection sensor in the conveyance path for a recording material, form an electrostatic latent image with precise timing based on a detection signal from the recording-material detection sensor, and transfer a toner image, formed by developing the electrostatic latent image, onto the recording material.

In addition, Japanese Patent Application Laid-Open No. 2003-248410 discusses the technique to detect the leading end position and lateral end position of a recording material by using an image sensor, calculate the amount of positional deviation based on the detected leading end position and lateral end position, and correct the writing start timing of an electrostatic latent image in the sub scanning direction and the writing start position in the main scanning direction.

However, the above-mentioned techniques to perform alignment between a recording material and a toner image have the following issues to deal with. Specifically, the conventional techniques, while being directed to the alignment between a recording material and a toner image, perform correction based not on the position detection at a portion where the toner image is transferred onto the recording material but on the position detection at a portion located upstream of that portion. Thus, the conventional techniques perform prediction-based correction and, therefore, may leave, as an actual transfer positional deviation, the sum of the amount of deviation of a toner image during the process from the formation of an electrostatic latent image to the arrival at the transfer position onto a recording material and the amount of deviation of the recording material during the process from the detection position for the recording material to the arrival at the transfer position onto the recording material.

Furthermore, to reduce any positional deviation, an installation engineer for the apparatus may be required, during installation of the apparatus, to repeat test printing and perform visual confirmation and adjustment of a print position relative to the recording material. Also, in some cases, a user may be required to regularly perform confirmation and adjustment of the print position.

More precise adjustment for alignment between a recording material and a toner image may require a test print with a plurality of sheets. Since the print position relative to a recording material may have variance, if a test print is performed with a single sheet, the print position may be greatly affected by such variance. Therefore, it is desirable to perform a test print with a plurality of sheets, for example, ten sheets, to confirm the print position for each printed sheet.

Furthermore, the print position may slightly vary depending on types of recording material, for example, plain paper, coated paper, and recycled paper. In addition, when the moisture content of paper changes depending on the environment where the recording material is placed, the expansion or contraction of the recording material may cause a difference in print position. These issues may affect printing accuracy. Also, a recording material that has been heated and pressed when passing through a fixing device, for example, during two-sided printing, expands or contracts due to a great change in moisture content. This issue may also affect printing accuracy. To deal with these conditions, such a cumbersome and complicated operation as to confirm the accuracy of a print position in each condition or mode may be required.

SUMMARY OF THE INVENTION

According to an aspect of the present invention, an image forming apparatus includes an image bearing member, an image forming unit configured to form a toner image on the image bearing member, a conveyance member configured to transfer the toner image onto a recording material and to convey the recording material, a detection member configured to detect the toner image on the conveyance member, and a control portion configured to form a test toner image on the image bearing member so as to extend over a region corresponding to the conveyance member and an end portion of the recording material, and to transfer the formed test toner image onto the conveyance member and the end portion of the recording material, and configured to set a position of a toner image, to be formed by the image forming unit, relative to the recording material based on a result of the detection member which detects the test toner image transferred onto the conveyance member.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

Figure 1:
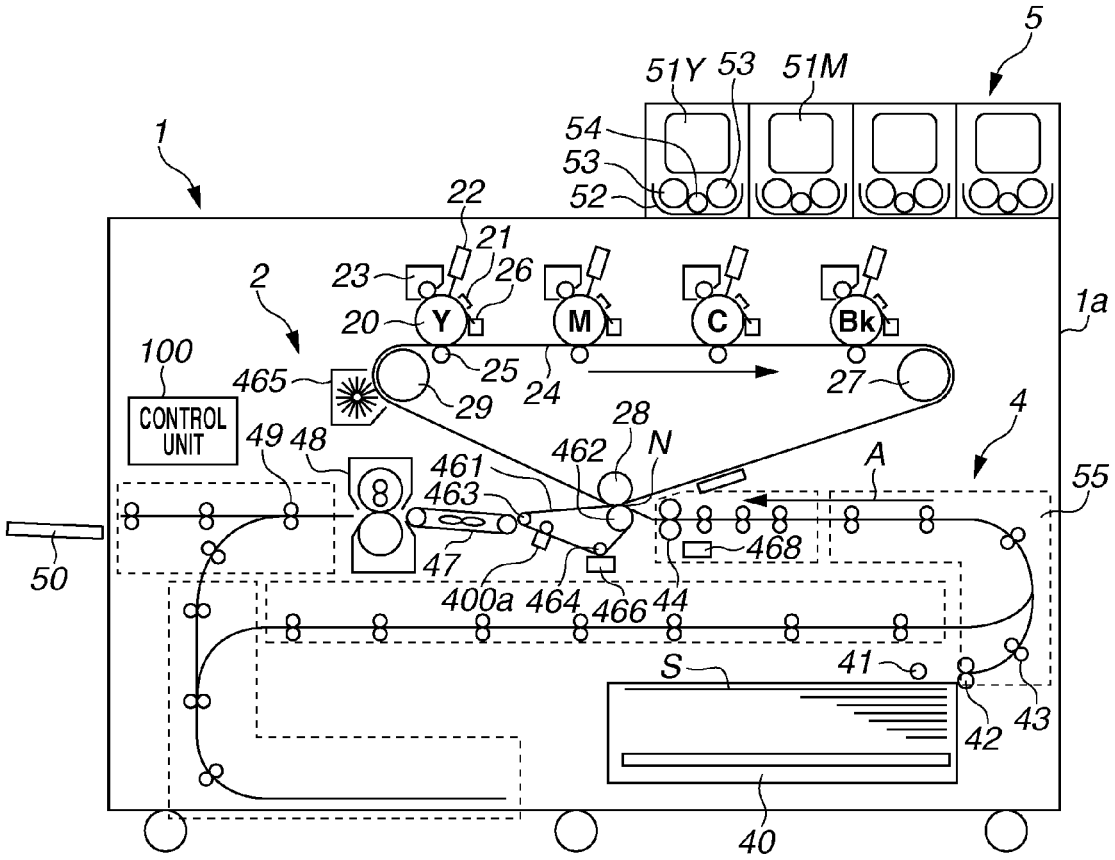
FIG. 1 is a schematic sectional view illustrating an image forming apparatus according to a first exemplary embodiment of the present invention.

FIG. 1 is a schematic sectional view illustrating an image forming apparatus 1 according to a first exemplary embodiment of the present invention.

[Overall Configuration of Image Forming Apparatus]

Referring to FIG. 1, the image forming apparatus 1 includes an image forming apparatus body (hereinafter referred to as an apparatus body) 1*a*. The upper portion of the apparatus body 1*a* contains an image forming unit 2 and the lower portion of the apparatus body 1*a* contains a recording material conveyance unit 4. A toner supply unit 5 is arranged on the top of the apparatus body 1*a*. The apparatus body 1*a* further contains a control unit 100, which controls each unit of the image forming apparatus 1.

[Image Forming Unit]

The image forming unit 2 includes stations for respective colors, Y (yellow), M (magenta), C (cyan), and Bk (black). Each station includes a photosensitive drum 20, which serves as an image bearing member, a charging device 21, which serves as a charging unit that uniformly charges the surface of the photosensitive drum 20, and a laser exposure unit 22, which serves as an exposure unit that forms an electrostatic latent image on the photosensitive drum 20. Each station further includes a developing device 23, which serves as a developing unit, a primary transfer roller 25, which serves as a primary transfer unit, a cleaner 26, which serves as a cleaning unit that removes residual toner on the photosensitive drum 20, and an intermediate transfer belt 24, which serves as another image bearing member. The image forming unit 2 is configured to form a toner image on the intermediate transfer belt 24.

The developing device 23 develops an electrostatic latent image on the photosensitive drum 20 into the toner image. The primary transfer roller 25 primarily transfers a toner image formed on the photosensitive drum 20 onto the intermediate transfer belt 24.

The charging device 21 uniformly charges the surface of the photosensitive drum 20. The laser exposure unit 22 forms an electrostatic latent image on the charged surface of the photosensitive drum 20. The developing device 23 develops the electrostatic latent image on the surface of the photosensitive drum 20 into a toner image with toner having a particle size of 5 to 10 μm. The primary transfer roller 25 transfer the toner image formed on the photosensitive drum 20 onto the intermediate transfer belt 24. The cleaner 26 removes residual toner on the photosensitive drum 20.

The intermediate transfer belt 24 is stretched around a driving roller 27, a secondary transfer inner roller 28, and a tension roller 29. The above-mentioned stations are arranged along the intermediate transfer belt 24. The intermediate transfer belt 24 is composed of an endless belt member having a total thickness of 310 μm and including, for example, an elastic layer of 230 μm thick coated on, for example, a polyimide (PI) layer of 80 μm thick.

[Toner Supply Unit]

The toner supply unit 5, which is arranged on the top of the apparatus body 1*a*, stores toner and appropriately supplies toner to each developing device 23. Sections of the toner supply unit 5 associated with the respective colors have similar configurations, and, therefore, only the section associated with magenta (M) is described here as an example. A toner cartridge 51M stores magenta (M) toner and contains a stirring member (not illustrated) that stirs, conveys, and discharges the toner. As the stirring member is driven to rotate by a driving unit (not illustrated), the magenta toner stored in the toner cartridge 51M is discharged to a developer container 52.

The developer container 52 includes an agitator 53 and a discharging screw 54. As the discharging screw 54 is rotated by a driving unit (not illustrated), toner is discharged and supplied to the developing device 23 associated with the corresponding color from a discharge port (not illustrated) disposed at a front side end of the developer container 52.

[Recording Material Conveyance Unit]

The recording material conveyance unit 4 includes a sheet feed cassette 40, which is located at the lower portion of the recording material conveyance unit 4, and a conveyance unit 55, which conveys a recording material S fed from the sheet feed cassette 40 toward a secondary transfer nip portion N. The recording material conveyance unit 4 further includes a secondary transfer belt 461, which conveys downstream the recording material S conveyed from the conveyance unit 55 and subjected to secondary transfer at the secondary transfer nip portion N, and a conveyance belt 47, which conveys the recording material S conveyed by the secondary transfer belt 461 to a fixing device 48.

In the recording material conveyance unit 4 configured as described above, the recording material S stored in the sheet feed cassette 40 is separated for each sheet by a sheet feed roller 41 and a separation roller pair 42 and is then conveyed to a registration roller pair 44 via a conveyance roller pair 43, etc., in the conveyance unit 55. The registration roller pair 44 is driven to rotate by a driving unit 468, which includes a motor and a gear mechanism that are controlled by the control unit 100.

On the other hand, a toner image primarily transferred onto the intermediate transfer belt 24 by the primary transfer roller 25, etc., is conveyed toward the secondary transfer nip portion N while being borne by the intermediate transfer belt 24. Then, the recording material S, having reached the position of the registration roller pair 44, is temporarily stopped there and is then conveyed by the registration roller pair 44 toward the secondary transfer nip portion N in synchronized timing with the position of the toner image on the intermediate transfer belt 24.

In the secondary transfer nip portion N, as a secondary transfer voltage opposite in polarity to toner is applied to a secondary transfer outer roller 462, the toner image is secondarily transferred from the intermediate transfer belt 24 onto the recording material S. Then, toner remaining on the intermediate transfer belt 24 after secondary transfer is removed for cleaning by a cleaner 465, which contacts the intermediate transfer belt 24.

The secondary transfer belt 461, which is an endless belt capable of rotating in the circumferential direction, constitutes a transfer and conveyance unit that transfers a toner image formed on the intermediate transfer belt 24, serving as an image bearing member, onto the recording material S and conveys the recording material S. Also, the registration roller pair 44 constitutes a conveyance unit that conveys the recording material S to the secondary transfer belt (the transfer and conveyance unit) 461.

The toner image on the intermediate transfer belt 24 is transferred onto the recording material S (onto the sheet) at the secondary transfer nip portion N, which is formed by the secondary transfer belt 461. The secondary transfer belt 461 is stretched around the secondary transfer outer roller 462, a driving roller 463, and a tension roller 464, which are arranged on the inner circumference side of the secondary transfer belt 461.

Toner remaining on the intermediate transfer belt 24 after secondary transfer performed at the secondary transfer nip portion N between the secondary transfer belt 461 and the intermediate transfer belt 24 is removed for cleaning by the cleaner 465, which is located downstream of the intermediate transfer belt 24. Also, patch images P1 to P4 (illustrated in FIG. 3), after being secondarily transferred onto the secondary transfer belt 461 (onto the transfer and conveyance unit) and then detected by a contact image sensor (CIS) 400*a*, are removed for cleaning by a cleaner 466, which is located below the secondary transfer nip portion N.

On the downstream side in the conveyance direction of the secondary transfer belt 461, there are arranged a conveyance belt 47, which conveys the recording material S, the fixing device 48, which fixes a toner image to the recording material S, a discharge roller pair 49, which discharges the recording material S subjected to fixing to outside the apparatus body 1*a*, and a discharge tray 50, on which the discharged recording material S is to be stacked. In this way, the recording material S subjected to secondary transfer at the secondary transfer nip portion N between the secondary transfer belt 461 and the intermediate transfer belt 24 is conveyed while being put on the secondary transfer belt 461 and is then discharged to the discharge tray 50 via the conveyance belt 47, the fixing device 48, and the discharge roller 49.

The CIS 400*a*, which serves as an image detection unit that detects a toner image on the secondary transfer belt 461, is arranged at a position opposite and close to the lower surface of the secondary transfer belt 461. The CIS 400*a* is formed in a long shape so as to be arranged along the main scanning direction (the direction from the near side to the far side as viewed in FIG. 1), i.e., the direction perpendicular to the conveyance direction (the direction indicated by arrow A in FIG. 1) of the recording material S, to detect patch images P1 to P4 (illustrated in FIGS. 2A and 2B) transferred onto the secondary transfer belt 461.

During ordinary image formation, the toner image is transferred only onto the recording material S and is, therefore, not applied onto the secondary transfer belt 461. Thus, the toner image is applied onto the secondary transfer belt 461 during detection of the relative position between the recording material S and the toner image, described below.

[Adjustment of Print Position]

Figure 2A:
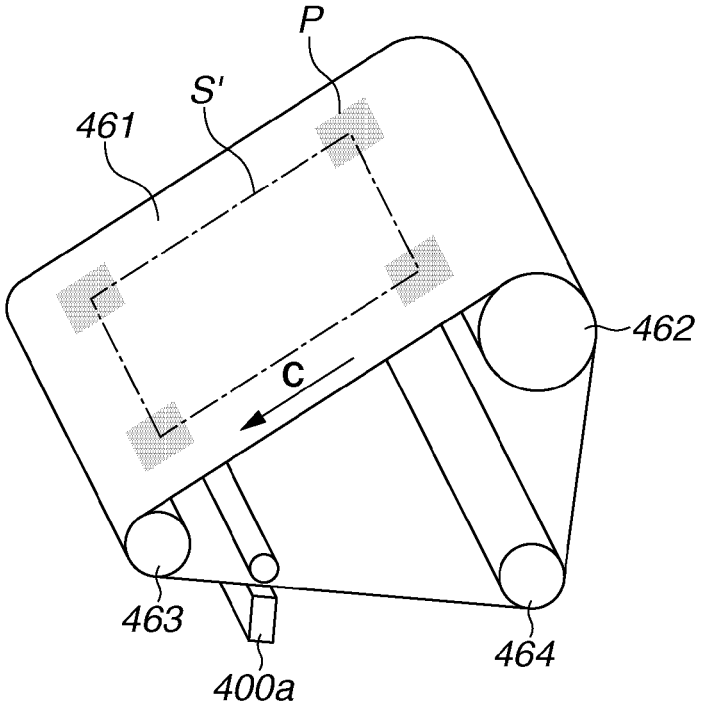
FIGS. 2A and 2B are magnified perspective views illustrating a secondary transfer belt, according to the first exemplary embodiment, in a state in which square-shaped patch images are formed on the secondary transfer belt and a state in which L-shaped patch images are transferred onto the secondary transfer belt, respectively.
Figure 2B:
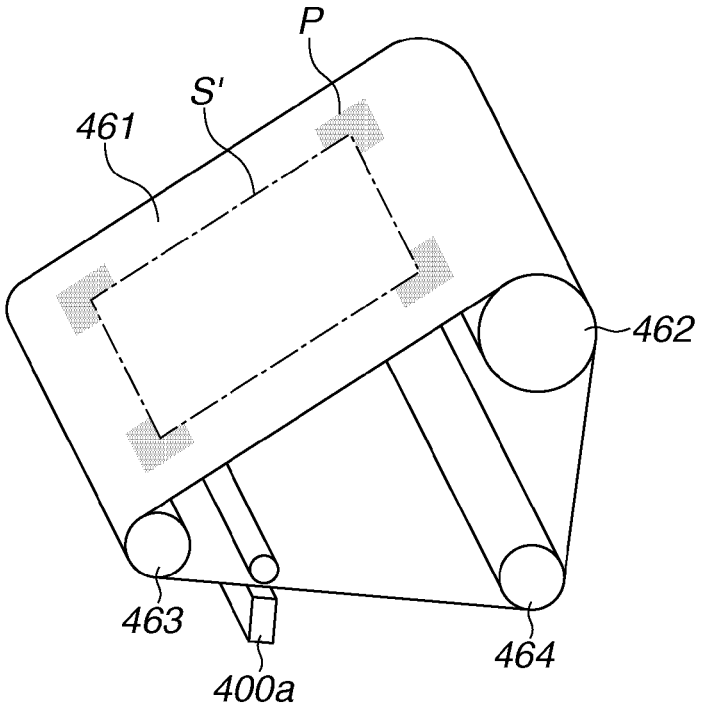

Next, the configuration for implementing a print position adjustment mode for detecting the relative position between the recording material S and the toner image is described. FIGS. 2A and 2B are perspective views illustrating the secondary transfer belt 461 stretched around rollers. FIG. 2A illustrates a state in which patch images P have been transferred onto the secondary transfer belt 461 without the recording material S being situated on the secondary transfer belt 461. FIG. 2B illustrates a state in which patch images P have been transferred onto the secondary transfer belt 461 with the recording material S being situated on the secondary transfer belt 461 (with the recording material S passing through the secondary transfer nip portion N).

As illustrated in FIG. 2A, onto the secondary transfer belt 461, which is rotated in the direction of arrow C, patch images P (P1 to P4) serving as corrective toner images are transferred so that parts thereof are situated to protrude outside a square (rectangular) range of the recording material S (indicated with two-dot chain line S' in FIG. 2A). Accordingly, when the recording material S passes through the secondary transfer nip portion N, parts of the patch images P1 to P4 are respectively transferred onto the four corners of the recording material S, and each of parts thereof protruding outside the recording material S is transferred in an L-shaped manner onto the secondary transfer belt 461, as illustrated in FIG. 2B.

The control unit 100 illustrated in FIG. 1 constitutes a correction control unit. The correction control unit (100) forms patch images (corrective toner images) P1 to P4 so as to extend over the secondary transfer belt 461 and the end portions of the recording material S, and then transfers the patch images P1 to P4 onto the secondary transfer belt 461 and the recording material S. Then, the correction control unit (100) performs control to correct the position of a toner image, to be formed by the image forming unit 2, relative to the recording material S based on a result obtained by causing the CIS (an image detection unit) 400*a* to detect the L-shaped toner images transferred onto the secondary transfer belt 461.

As the size of the patch image P is made as small as possible while being larger than the relative positional deviation between the recording material S and the patch image S, and as the density of the patch image S is made as low as possible within a range detectable by the CIS 400*a*, the consumption of toner due to formation of the patch image P can be more reduced. In the present exemplary embodiment, each of the four patch images P1 to P4 is a square, 6 mm on a side, has a density of 80% of the maximum application amount, and is formed with yellow (Y) toner. However, this is not a restrictive one.

In general, the positional deviation in the main scanning direction (in the direction of width of the belt) tends to be smaller than the positional deviation in the sub scanning direction (in the direction of circumference of the belt). Therefore, according to the positional deviation in the main scanning direction, the size of the patch image P in the main scanning direction can be made smaller. Furthermore, while in the present exemplary embodiment the four patch images P1 to P4 are configured to have the same shape and size, besides these configurations, the size of each patch image can be appropriately changed.

Figure 3:
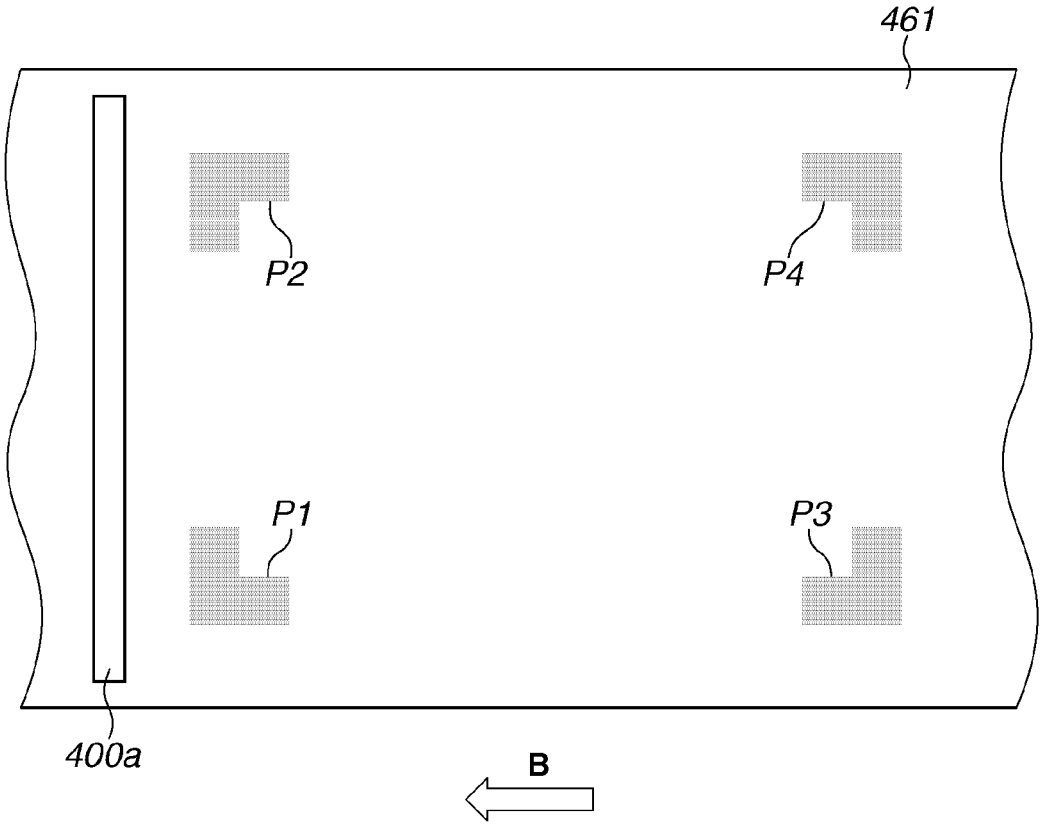
FIG. 3 is a development view illustrating the secondary transfer belt according to the first exemplary embodiment.

FIG. 3 is a development view illustrating a state in which the secondary transfer belt 461 illustrated in FIG. 2B is developed in a planar manner. As illustrated in FIG. 3, the secondary transfer belt 461 moves from the right-hand side to the left-hand side in this figure in the direction indicated by arrow B. In this case, after patch images P1 to P4 are transferred onto the secondary transfer belt 461 so as to extend over end portions of the recording material S, portions of the patch images P1 to P4 each remain in an L-shaped manner on the secondary transfer belt 461 after the movement of the recording material S. As the secondary transfer belt 461 moves, the remaining portions of the patch images P1 to P4 sequentially reach the reading position at which the CIS 400*a* performs detection.

Figure 4:
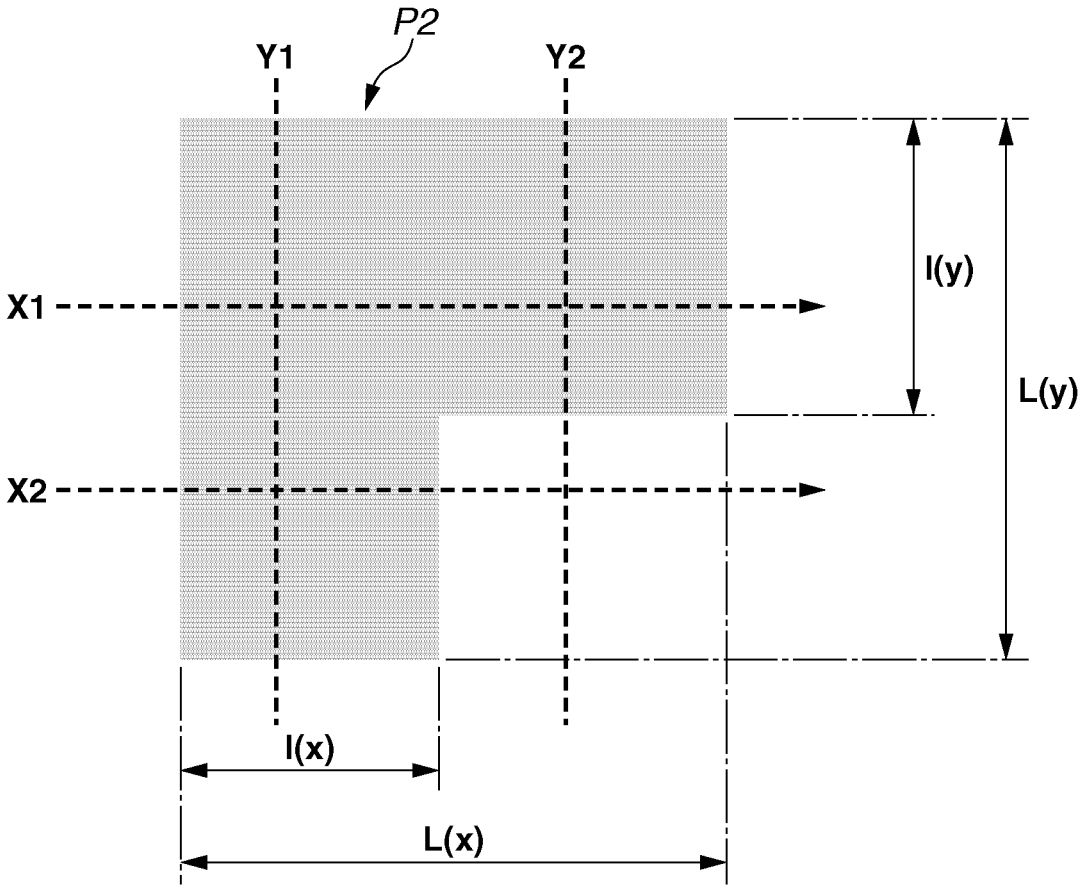
FIG. 4 is a magnified view of a patch image according to the first exemplary embodiment.
Figure 5A:
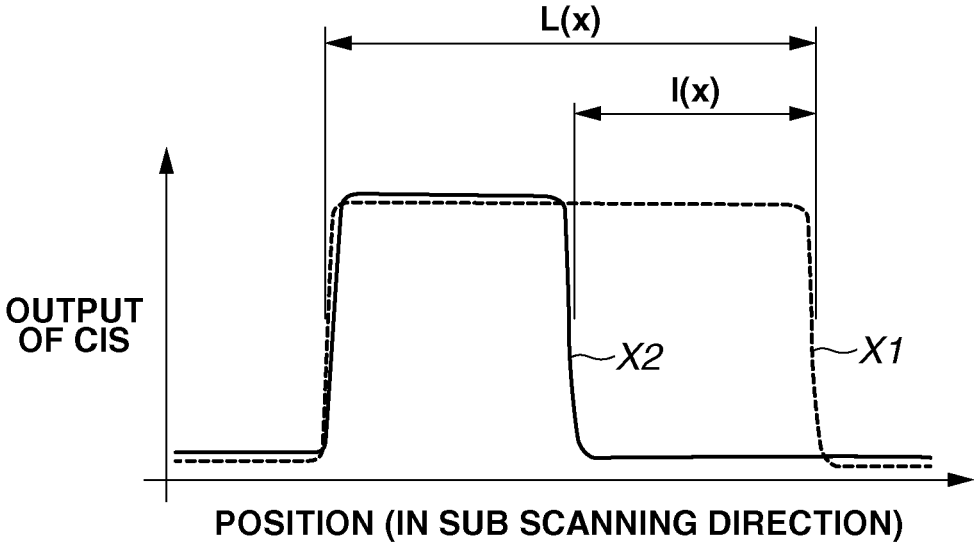
FIGS. 5A and 5B are graph charts illustrating outputs of a contact image sensor (CIS) obtained in the sub scanning direction and in the main scanning direction, respectively.
Figure 5B:
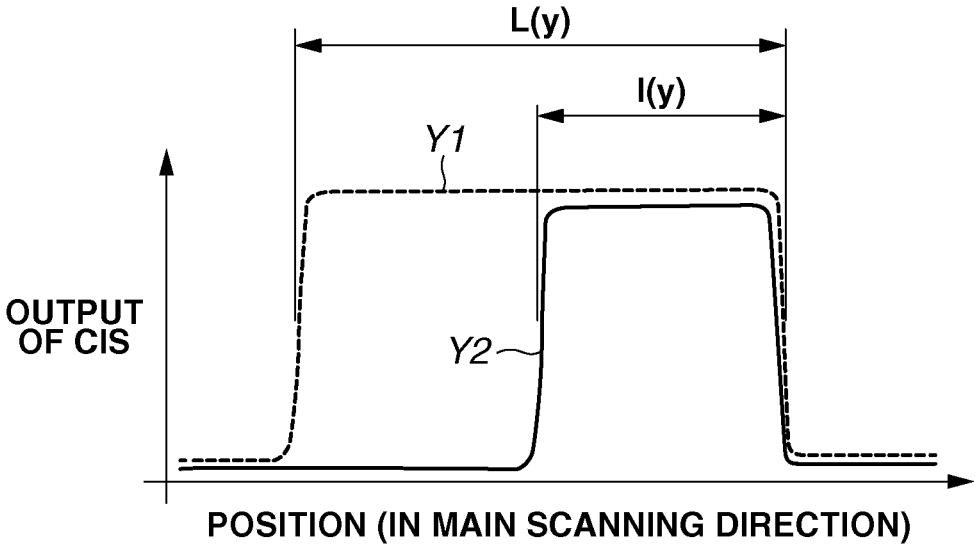

Next, a method for detecting the patch image P by the CIS 400*a*, serving as an image detection unit, is described with reference to FIGS. 4, 5A, and 5B. FIG. 4 is a magnified view of the patch image P2. FIGS. 5A and 5B are graph charts illustrating outputs of the CIS 400*a* obtained in the sub scanning direction and in the main scanning direction, respectively.

In FIG. 4, dashed-line arrows X1 and X2 denote lines that are detected by light receiving elements of the CIS 400*a* as the secondary transfer belt 461 moves (i.e., as time advances). Dashed lines Y1 and Y2 denote lines that are detected by the CIS 400*a* at times t1 and t2, respectively.

The detection levels obtained by the CIS 400*a* at the dashed-line arrows X1 and X2 and the dashed lines Y1 and Y2 are illustrated in FIGS. 5A and 5B, respectively. In the graph of FIG. 5A, the abscissa axis indicates a time axis, which is converted into a distance (a position in the sub scanning direction) based on the conveyance speed of the secondary transfer belt 461 (in the present exemplary embodiment, for example, 295 mm/s). In the graph of FIG. 5B, the abscissa axis indicates a position in the main scanning direction.

In the present exemplary embodiment, four patch images P1 to P4 shaped in a square, 6 mm on a side, are formed such that the center of each patch image is situated at a corresponding one of the four corners of an A3-size recording material (297×420 mm).

In the graphs of FIGS. 5A and 5B, L(x) and L(y) represent the length of each side of the patch image P. In the present exemplary embodiment, the length is 6 mm as described above. Also, l(x) and l(y) represent the lengths of the respective sides of the L-shaped portion of the patch image P, on which toner is applied in an L-shaped manner. X indicates the direction parallel to the recording material conveyance direction (the sub scanning direction), and Y indicates the direction parallel to the width direction (the main scanning direction) perpendicular to the recording material conveyance direction.

If the patch images P1 to P4 are situated at their desired positions relative to the recording material S, the detection levels obtained by the CIS 400*a* illustrated in FIGS. 5A and 5B indicate that both the lengths l(x) and l(y) of the sides of the L-shaped portion, on which toner is applied in an L-shaped manner, are 3 mm. A difference between each of the lengths l(x) and l(y) of the sides of the L-shaped portion and 3 mm corresponds to the amount of deviation in print position between the recording material S and a toner image formed at the time of normal printing.

Although the above description has been made with respect to the patch image P2, which is an example of a corrective toner image, the same is true on the other patch images P1, P3, and P4, which are also examples of corrective toner images.

Figure 6:
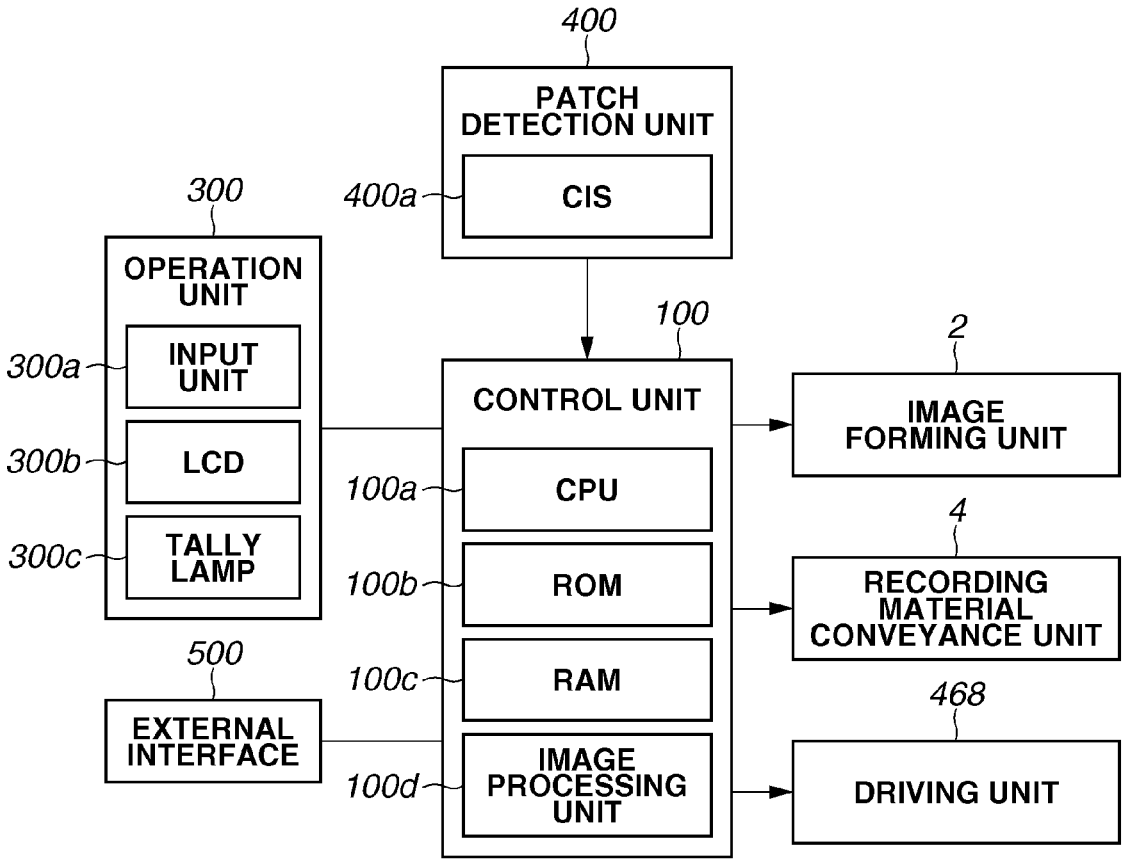
FIG. 6 is a block diagram illustrating a control system of the image forming apparatus according to the first exemplary embodiment.
Figure 7:
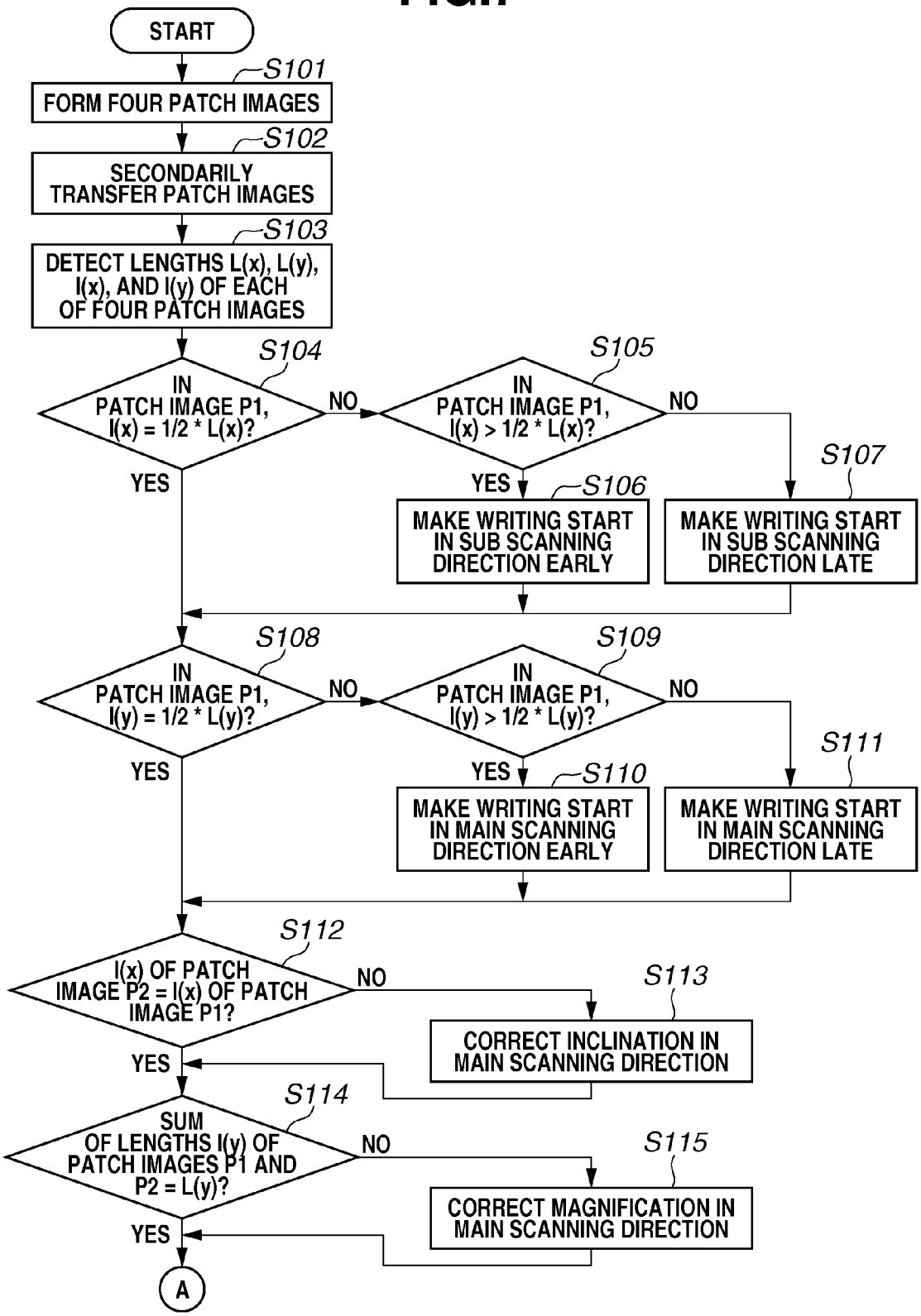
FIG. 7 is a flowchart illustrating calculation and correction processing according to the first exemplary embodiment.
Figure 8:
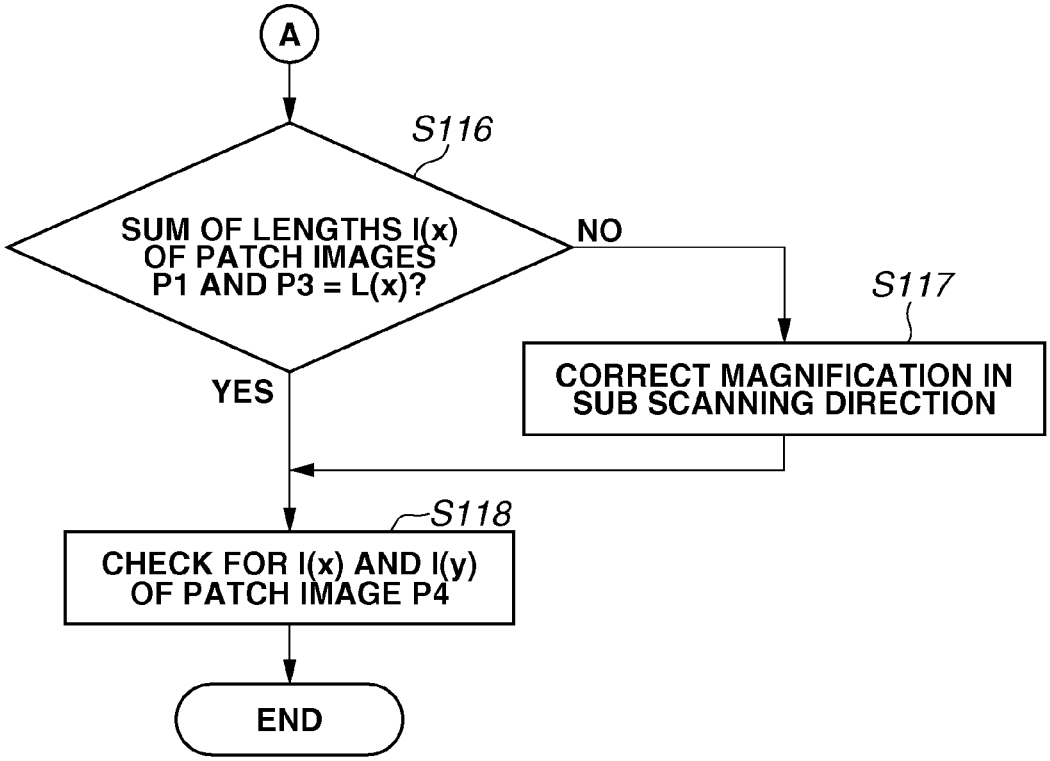
FIG. 8 is a flowchart illustrating calculation and correction processing according to the first exemplary embodiment.

Next, a control operation for detecting and correcting the print position of a toner image relative to the recording material S is described with reference to FIGS. 6 to 8. FIG. 6 is a block diagram illustrating a control system of the image forming apparatus 1 according to the present exemplary embodiment. FIGS. 7 and 8 are flowcharts illustrating calculation and correction processing according to the present exemplary embodiment.

Referring to FIG. 6, the control unit 100 (also illustrated in FIG. 1), which also functions as a correction control unit, includes a central processing unit (CPU) 100*a*, which performs calculation, etc., a read-only memory (ROM) 100*b*, which stores a program, etc., a random access memory (RAM) 100*c*, which executes various types of processing, and an image processing unit 100*d*.

The control unit 100 is connected to the image forming unit 2, which includes the photosensitive drum 20, the charging device 21, the laser exposure unit 22, the developing device 23, the primary transfer roller 25, and the secondary transfer outer roller 462. The control unit 100 is further connected to the recording material conveyance unit 4, which includes the conveyance belt 47, the secondary transfer belt 461, and the conveyance unit 55. The control unit 100 is further connected to an operation unit 300, a patch detection unit 400, an external interface 500 for connection with a peripheral device (not illustrated), and the driving unit 468.

The operation unit 300, which is mounted on the top surface of the apparatus body 1*a*, includes an input unit 300*a*, a liquid crystal display (LCD) 300*b*, and a tally lamp 300*c*. A user or an operator who performs an adjustment work can enter information via the input unit 300*a*.

The patch detection unit 400 includes the CIS 400*a*, serving as an image detection unit, which detects the patch images P1 to P4 at a position opposite and close to the secondary transfer belt 461.

The control unit 100, which serves as a correction and control unit, forms the patch images P1 to P4 so as to extend over the respective end portions of the recording material S in the conveyance direction and the secondary transfer belt 461. Then, the control unit 100 performs control to correct the image writing start timing by the image forming unit 2 in the recording material conveyance direction of the secondary transfer belt 461 based on a result of detection of the patch images P1 to P4 by the CIS 400*a*. In this case, if at least the patch images P1 and P2, or the patch images P3 and P4, which extend over the respective end portions in the conveyance direction of the recording material S and the secondary transfer belt 461 are formed as patch images, the control operation for correcting the image writing start timing by the image forming unit 2 can also be performed although the accuracy thereof somewhat decreases.

The control unit 100 forms the patch images P1 to P4 so as to extend over the respective end portions in the width direction, which is perpendicular to the conveyance direction of the recording material S, and the secondary transfer belt 461. Then, the control unit 100 performs control to correct the image writing start position by the image forming unit 2 in the width direction based on a result of detection of the patch images P1 to P4 by the CIS 400*a*. In this case, if at least the patch images P2 and P4, or the patch images P1 and P3, which extend over the respective end portions in the width direction of the recording material S and the secondary transfer belt 461, are formed as patch images, the control operation for correcting the image writing start position by the image forming unit 2 can also be performed although the accuracy thereof somewhat decreases.

With the above-described configuration, when an input for adjusting the print position is given by the operator via the operation unit 300, patch images P1 to P4 (illustrated in FIG. 3) are formed at positions corresponding to the respective four corners of a predetermined recording material (in the present exemplary embodiment, an A3-size recording material). Thus, as described above, L-shaped patch images P1 to P4, which are portions that protrude outside the recording material S, are transferred onto the secondary transfer belt 461. The CIS 400*a* of the patch detection unit 400 detects the L-shaped patch images P1 to P4 and sends a detection signal indicative of a result of the detection to the control unit 100.

Then, the control unit 100 calculates the amount of deviation using the detection method described in FIGS. 4 and 5 based on the detection signal received from the CIS 400*a*, and calculates a correction amount based on the calculated amount of deviation. Then, during normal image formation, the image forming apparatus 1 performs image formation with the position and size corrected based on the correction amount to apply a toner image onto the recording material S.

A detection signal output from the CIS 400*a* and calculation and correction operations of the control unit 100 are described below with reference to the flowcharts of FIGS. 7 and 8.

When the operator performs, via the operation unit 300, an input operation for adjusting the positional deviation, then in step S101, the control unit 100 controls the image forming unit 2 to form four patch images P1 to P4.

The process for forming the patch images P1 to P4 is substantially similar to a conventional image forming process. The scanning direction of laser beams by the laser exposure unit 22 is a direction pointing from the patch image P1 or P3 to the patch image P2 or P4, in other words, from the lower side to the upper side as viewed in FIG. 3.

In step S102, the control unit 100 controls the image forming unit 2 to sequentially transfer the formed four patches P1 to P24 onto the secondary transfer belt 461. At this time, at the secondary transfer nip portion N, there is the recording material S conveyed by the recording material conveyance unit 4. Consequently, L-shaped patch images, which protrude outside the recording material S, are applied onto the recording material S, as illustrated in FIG. 3. In step S103, the control unit 100 detects, via the CIS 400*a*, the lengths L(x) and L(y) of the respective sides of each of the patch images P1 to P4 and the lengths l(x) and l(y) of the L-shaped portion of each of the patch images P1 to P4 (see FIGS. 4, 5A, and 5B).

The determination of each L-shaped patch image is described below. Starting with step S104, the control unit 100, serving as a correction control unit, performs the determination of the patch images P1 to P4 in order from the patch image P1 to determine whether the length l(x) of the L-shaped portion, on which L-shaped toner is applied, is equal to half of the length L(x) of one side, i.e., equal to 3 mm.

More specifically, in step S104, the control unit 100, serving as a correction control unit, determines whether the length l(x) of the L-shaped portion in the patch image P1 is equal to half of the length L(x) of one side (½×L(x)). If the length l(x) is equal to half of the length L(x) (YES in step S104), the processing proceeds to step S108. Otherwise (NO in step S104), the processing proceeds to step S105.

In step S105, the control unit 100 determines whether the length l(x) of the L-shaped portion is larger than half of the length L(x) of one side. If the length l(x) of the L-shaped portion is larger than half of the length L(x) of one side (½×L(x)) (YES in step S105), this means that an image in the sub scanning direction deviates relative to the recording material S toward the downstream side in the conveyance direction. Accordingly, in step S106, the control unit 100 controls the image forming unit 2 to make the image writing start timing in the sub scanning direction early.

On the other hand, if the length l(x) of the L-shaped portion is smaller than half of the length L(x) of one side (NO in step S105), this means that an image in the sub scanning direction deviates relative to the recording material S toward the upstream side in the conveyance direction. Accordingly, in step S107, the control unit 100 controls the image forming unit 2 to make the image writing start timing in the sub scanning direction late, thus delaying image formation relative to the recording material S.

In step S108, the control unit 100 determines whether the length l(y) of the L-shaped portion in the patch image P1 is equal to half of the length L(y) of one side (½×L(y)). If the length l(y) is equal to half of the length L(y) (YES in step S108), the processing proceeds to step S112. Otherwise (NO in step S108), the processing proceeds to step S109.

In step S109, the control unit 100 determines whether the length l(y) of the L-shaped portion is larger than half of the length L(y) of one side. If the length l(y) of the L-shaped portion is larger than half of the length L(y) of one side (½×L(y)) (YES in step S109), this means that an image in the main scanning direction deviates relative to the recording material S toward the outer side (toward the lower side as viewed in FIG. 3). Accordingly, in step S110, the control unit 100 controls the image forming unit 2 to make the image writing start timing at each line in the main scanning direction early.

On the other hand, if the length l(y) of the L-shaped portion is smaller than half of the length L(y) of one side (NO in step S109), this means that an image in the main scanning direction deviates relative to the recording material S toward the inner side (toward the upper side as viewed in FIG. 3). Accordingly, in step S111, the control unit 100 controls the image forming unit 2 to make the image writing start timing at each line in the main scanning direction late, thus delaying image formation relative to the recording material S to shift an image toward the inner side of the recording material S.

In step S112, the control unit 100 compares the length l(x) of the L-shaped portion in the patch image P1 with that in the patch image P2 to determine any inclination in the main scanning direction (the belt width direction). If the length l(x) of the L-shaped portion in the patch image P1 is equal to that in the patch image P2 (YES in step S112), the processing proceeds to step S114. Otherwise (NO in step S112), the processing proceeds to step S113.

In step S113, the control unit 100 performs control to correct the inclination in the main scanning direction. Specifically, the control unit 100 inclines image data such that the image forming unit 2 causes the inclined image to turn in a direction to offset the inclination. While, in the present exemplary embodiment, the control unit 100 performs correction by inclining image data, another correction method may be employed. For example, the control unit 100 may control the driving unit 468 to adjust the inclination of the registration roller pair 44 in such a way as to incline the recording material S.

In step S114, the control unit 100 determines whether the sum of the lengths l(y) of the L-shaped portions in the patch image P1 and the patch image P2 is equal to the length L(y) of one side. In the present exemplary embodiment, as described above, one side of the patch image P is set to 6 mm, and the length l(y) of the L-shaped portion when the patch image P is located in an ideal position is set to 3 mm, which is half of 6 mm.

Therefore, if the sum of the lengths l(y) of the L-shaped portions in the patch image P1 and the patch image P2 is not equal to the length L(y) of one side (NO in step S114), the processing proceeds to step S115. In step S115, the control unit 100 corrects the size (magnification) of an image in the main scanning direction. More specifically, if the sum of the lengths l(y) of the L-shaped portions in the patch image P1 and the patch image P2 is smaller than 6 mm, the control unit 100 controls the laser exposure unit 22 to change laser radiation in such a way as to enlarge the image. Conversely, if the sum is larger than 6 mm, the control unit 100 controls the laser exposure unit 22 to change laser radiation in such a way as to reduce the image.

In step S116, the control unit 100 determines whether the sum of the lengths l(x) of the L-shaped portions in the patch image P1 and the patch image P3 is equal to the length L(x) of one side. If the sum of the lengths l(x) of the L-shaped portions in the patch image P1 and the patch image P3 is not equal to the length L(x) of one side (NO in step S116), the processing proceeds to step S117. In step S117, the control unit 100 corrects the size (magnification) of an image in the sub scanning direction (the belt circumferential direction). More specifically, if the sum of the lengths l(x) of the L-shaped portions in the patch image P1 and the patch image P3 is smaller than 6 mm, the control unit 100 controls the laser exposure unit 22 to change laser radiation in such a way as to enlarge the image. Conversely, if the sum is larger than 6 mm, the control unit 100 controls the laser exposure unit 22 to change laser radiation in such a way as to reduce the image.

In step S118, the control unit 100 detects and checks for the lengths l(x) and l(y) of the L-shaped portion in the patch image P4 and then terminates a series of operations for detecting the patch images P1 to p4 via the CIS 400*a* and performing correction.

Then, the control unit 100 performs such a series of operations a plurality of times until the lengths l(x) and l(y) of the L-shaped portion in the patch image P4 converge within respective predetermined ranges in step S118, thus completing the position adjustment between a toner image and the recording material S. In the present exemplary embodiment, specifically, the control unit 100 performs the control operation until the lengths l(x) and l(y) of the L-shaped portion in the patch image P4 converge within a range from 2.6 to 3.4 mm.

As described above, the control unit 100 controls the position of a toner image, to be formed, relative to the recording material S based on the lengths (L(x) and l(x)) in the conveyance direction and the lengths (L(y) and l(y)) in the width direction perpendicular to the conveyance direction, of the patch images P1 to P4, which are transferred onto the secondary transfer belt 461.

While, in the present exemplary embodiment, each of the patch images P1 to P4 is shaped in a square, 6 mm on a side, this shape can be changed as appropriate. For example, the respective sizes of the patch images P1 to P4 may be changed such that the patch images P1 and P2, which are situated on the downstream side in the recording medium conveyance direction (the direction indicated by arrow B) in FIG. 3, are shaped in a square, 4 mm on a side, and the patch images P3 and P4, which are situated on the upstream side, are shaped in a square, 6 mm on a side.

Alternatively, the square patch image P can be changed to a rectangular patch image having a size of, for example, 4 mm×6 mm. In this case, the criterion for determination in step S112, etc., is to be changed as appropriate in such a manner as to cope with a rectangular patch shape.

While, in the present exemplary embodiment, the control unit 100 uses the patch image P4 in step S118 to perform adjustment until the completion of convergence within a desired range, the control unit 100 can perform adjustment, without using the patch image P4, by performing the processing in steps S101 to S117 a plurality of times (for example, five times).

The present exemplary embodiment uses the intermediate transfer belt 24, which has an elastic layer as the surface layer. Therefore, even when a thick recording material having a grammage of, for example, 300 g/m$^2$ is used, the present exemplary embodiment can transfer a patch image having a distinct boundary edge onto the secondary transfer belt 461 to enable the CIS 400*a* to accurately detect the patch image. However, this configuration is not a restrictive one. The present exemplary embodiment can also use an intermediate transfer belt 24 having no elastic layer. Incidentally, the present exemplary embodiment performs transfer of the patch images P1 to P4 with a secondary transfer bias voltage that is lower, for example, 700 V than that used for transfer on an ordinary recording material, so as to transfer a good patch image onto the secondary transfer belt 461.

In the present exemplary embodiment described above, the patch images P1 to P4 are formed so as to extend over the respective four corner portions, among a plurality of (four) corner portions, of the rectangular recording material S and the secondary transfer belt 461. However, even if patch images P1 to P3 are formed so as to extend over at least three of the corner portions of the rectangular recording material S and the secondary transfer belt 461, the present exemplary embodiment can perform similar correction control for image writing start timing and/or similar correction control for image writing start position.

According to the present exemplary embodiment, a result of detection in a position where a toner image is transferred onto the recording material S can be reflected. Accordingly, the amount of deviation of a print position relative to the recording material S can be appropriately corrected, and the print position can be readily adjusted without relying on visual measurement or manual adjustment. In other words, since the relative position between the recording material S and a toner image is directly detected, the alignment between the recording material S and the toner image can be accurately performed.

In addition, since the relative position between the recording material S and the toner image is able to be detected within the apparatus body 1*a* without human work by a user or operator, the alignment between the recording material S and the toner image can be readily performed. Furthermore, since patch images are formed at a plurality of corner portions of the rectangular recording material S, both the positions in the sub scanning direction (the recording material conveyance direction) and the main scanning direction (the belt width direction) can be detected.

Figure 9:
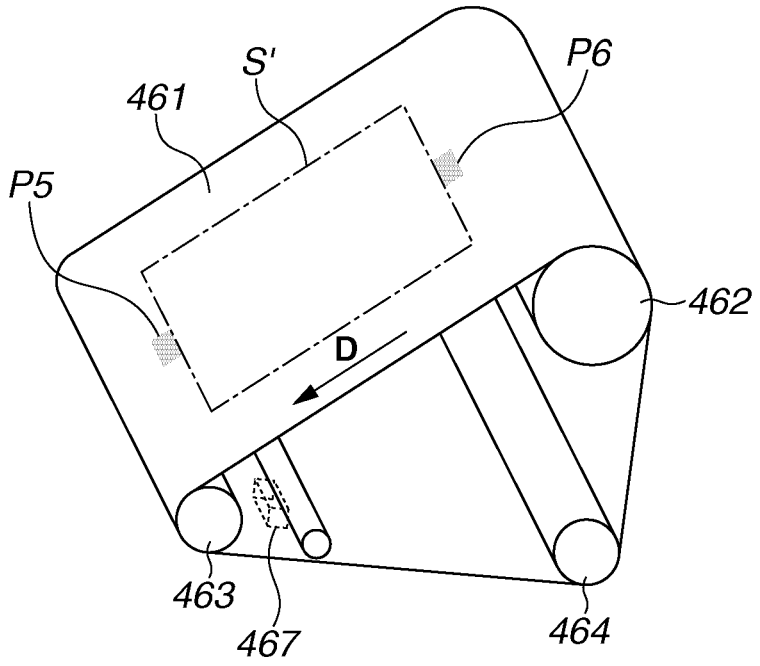
FIG. 9 is a magnified view illustrating a secondary transfer belt according to a second exemplary embodiment of the present invention.

Next, an image forming apparatus according to a second exemplary embodiment of the present invention is described with reference to FIG. 9. FIG. 9 illustrates a state in which patch images P5 and P6 according to the second exemplary embodiment are transferred onto the secondary transfer belt 461. In the second exemplary embodiment, members and components having similar functions to those of the members and components described in the first exemplary embodiment are assigned the same reference numerals, and, therefore, the description thereof is not repeated here.

In the first exemplary embodiment describe above, four patch images P1 to P4 are formed on the secondary transfer belt 461, and the position of the toner image relative to the recording material S is adjusted based on a result of detection of the patch images P1 to P4. However, in the case of the secondary exemplary embodiment, two patch images P5 and P6 are formed on the secondary transfer belt 461, and the position of the toner image relative to the recording material S is adjusted based on a result of detection of the patch images P5 and P6.

More specifically, as illustrated in FIG. 9, a reflection-type sensor 467, serving as an image detection unit, is located at a position opposite and close to the bottom surface of the secondary transfer belt 461. The reflection-type sensor 467 is arranged along the main scanning direction (the belt width direction), which is perpendicular to the sub scanning direction (the belt circumferential direction indicated by arrow D), to detect the patch images P5 and P6 on the secondary transfer belt 461.

Referring to FIG. 9, the patch images P5 and P6 are formed substantially in the middle of an image area of the secondary transfer belt 461 in the main scanning direction (the belt width direction). Each of the patch images P5 and P6 is formed in a square, 6 mm on a side, such that the centers of the patch images P5 and P6 are situated respectively at the downstream end and the upstream end of an A3-size recording material (297×420 mm). In FIG. 9, there is illustrated a position S' where the recording material S is to be put on the secondary transfer belt 461.

If the length of each of the patch images P5 and P6 on the secondary transfer belt 461 in the sub scanning direction (the belt circumferential direction) is 3 mm, it is determined that a toner image is situated in a desired correct position. For example, if the length of the patch image P5 is 2 mm and the length of the patch image P6 is 2.5 mm, the control unit 100 delays the writing start timing in the sub scanning direction by 1 mm so that a toner image is situated in a desired position.

In addition, the sum of 2 mm and 2.5 mm is equal to 4.5 mm, which is less than 6 mm by 1.5 mm. The sum of the lengths of the patch images P5 and P6 on the secondary transfer belt 461 being less means that the toner image is smaller with respect to the recording material S. Therefore, if the toner image is formed in a size larger by 1.5 mm, the overall magnification of the toner image can match the recording material S.

As described above, the control unit 100 according to the second exemplary embodiment forms the patch images P5 and P5 so as to extend over a respective one of two opposite sides of the rectangular recording material S and the secondary transfer belt 461. Then, the control unit 100 performs control to correct the magnification of a toner image, to be formed by the image forming unit 2, relative to the recording material S based on a result of detection of the patch images P5 and P6 via the reflection-type sensor 467. The method for correcting the magnification according to the second exemplary embodiment can be similarly applied to the above-described first exemplary embodiment.

In addition, the control unit 100 can form patch images P5 and P6 so as to extend over a respective one of the end portions of the recording material S in the conveyance direction and the secondary transfer belt 461, and can control the driving unit 468 based on a result of detection of the patch images P5 and P6 to correct the conveyance timing of the registration roller pair 44. While, in the second exemplary embodiment, only the patch images P5 and P6 are formed so as to extend over a respective one of the end portions of the recording material S in the conveyance direction and the secondary transfer belt 461, the method for correcting the conveyance timing can be also applied to a case where patch images other than the patch images P5 and P6 are formed. Furthermore, the method for correcting the conveyance timing can be also applied to the above-described first exemplary embodiment.

In the second exemplary embodiment, the control unit 100 forms patch mages P5 and P6 so as to extend over a respective one of the upstream end and the downstream end of the recording material S in the conveyance direction and the secondary transfer belt 461. Then, the control unit 100 corrects the position of a toner image, to be formed by the image forming unit 2, relative to the recording material S based on the lengths, in the recording material conveyance direction, of the patch images P5 and P6 transferred onto the secondary transfer belt 461.

While, in the above-described first exemplary embodiment, the CIS 400*a* detects the patch images P1 to P4, the second exemplary embodiment uses the reflection-type sensor 467 to detect only the lengths of the patch images P5 and P6 in the sub scanning direction (the belt circumferential direction). In other words, the second exemplary embodiment forms only the patch images P5 and P6 at two portions, the upstream end portion and the downstream end portion, in the sub scanning direction, and, therefore, can detect the position in the sub scanning direction by using an inexpensive sensor, such as the reflection-type sensor 467.

In addition, the second exemplary embodiment cannot perform detection in the main scanning direction and, therefore, cannot perform correction in the main scanning direction. However, the second exemplary embodiment can be applied at low cost to products in which the variance of a print position in the sub scanning direction is larger than in the main scanning direction and the amount of deviation in the main scanning direction is at an acceptable level.

The first and second exemplary embodiments have been described above with the image forming apparatus 1 using the secondary transfer belt 461. However, this is not a restrictive one. The first and second exemplary embodiments can be also applied to an image forming apparatus having a direct transfer type configuration. In addition, the first and second exemplary embodiments have been described above with the image forming apparatus 1 using a plurality of color toners for yellow (Y), magenta (M), cyan (C), and black (Bk). However, the first and second exemplary embodiments can be also applied to a monochromatic image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-061606 filed Mar. 25, 2013, which is hereby incorporated by reference herein in its entirety.

What is claimed is:

1. An image forming apparatus comprising:

an image bearing member;

an image forming unit configured to form a toner image on the image bearing member;

a conveyance member configured to transfer the toner image onto a recording material and to convey the recording material;

a detection member configured to detect the toner image on the conveyance member; and a control portion configured to form a test toner image on the image bearing member so as to extend over a region corresponding to the conveyance member and an end portion of the recording material, and to transfer the formed test toner image onto the conveyance member and the end portion of the recording material, and configured to set a position of a toner image, to be formed by the image forming unit, relative to the recording material based on a result of the detection member which detects the test toner image transferred onto the conveyance member.

2. The image forming apparatus according to claim 1, wherein the control portion forms the test toner image on the image bearing member so as to extend over a region corresponding to at least an end portion of the recording material in a conveyance direction thereof and the conveyance member, and sets an image writing start timing by the image forming unit in the conveyance direction by the conveyance member based on a result of the detection member.

3. The image forming apparatus according to claim 1, wherein the control portion forms the test toner image on the image bearing member so as to extend over a region corresponding to at least an end portion of the recording material in a width direction perpendicular to a conveyance direction thereof and the conveyance member, and sets an image writing start position by the image forming unit in the width direction based on a result of the detection member.

4. The image forming apparatus according to claim 1, wherein the control portion forms the test toner images on the image bearing member so as to extend over a region corresponding to a respective one of opposite sides of the recording material, and the conveyance member, and sets a magnification of a toner image relative to the recording material based on a result of detection of the detection member.

5. The image forming apparatus according to claim 1, further comprising a supply member configured to supply a recording material to the conveyance member, wherein the control portion forms the test toner image on the image bearing member so as to extend over a region corresponding to at least an end portion of the recording material in a conveyance direction thereof and the conveyance member, and sets a supply timing by the supply member based on a result of the detection member.

6. The image forming apparatus according to claim 1, wherein the conveyance member includes an endless belt that is movable in a circumferential direction thereof.

7. The image forming apparatus according to claim 1, wherein the control portion forms the test toner images on the image bearing member so as to extend over a region corresponding to at least three corner portions, among four corner portions, of the recording material, which is rectangular, and the conveyance member.

8. The image forming apparatus according to claim 1, wherein the control portion sets the position of the toner image relative to the recording material based on a length, in a conveyance direction of the recording material, and a length, in a width direction perpendicular to the conveyance direction, of the test toner image transferred onto the conveyance member.

9. The image forming apparatus according to claim 1, wherein the control portion forms the test toner images on the image bearing member so as to extend over a region corresponding to a respective one of an upstream end portion and a downstream end portion, in a conveyance direction, of the recording material, and the conveyance member.

10. The image forming apparatus according to claim 1, wherein the control portion sets the position of the toner image relative to the recording material based on a length, in a conveyance direction of the recording material, of the test toner image transferred onto the conveyance member.

* * * * *